US006962332B2

(12) United States Patent
Su

(10) Patent No.: US 6,962,332 B2
(45) Date of Patent: Nov. 8, 2005

(54) MEDIA CONVEYING MECHANISM

(75) Inventor: Yu-Jen Su, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 20 days.

(21) Appl. No.: 10/715,510

(22) Filed: Nov. 19, 2003

(65) Prior Publication Data

US 2005/0104275 A1 May 19, 2005

(51) Int. Cl.[7] ..... B65H 5/22

(52) U.S. Cl. ..... 271/4.01; 271/4.03; 271/4.04; 271/4.1; 271/10.01; 271/10.03; 271/10.04; 271/10.11; 271/10.12; 271/10.13; 271/242

(58) Field of Search ..... 271/4.01, 4.03, 271/4.04, 4.08, 4.1, 10.01, 10.03, 10.04, 271/10.05, 10.09, 10.11, 10.12, 10.13, 242

(56) References Cited

U.S. PATENT DOCUMENTS 3,961,786 A * 6/1976 Yanker ..... 271/122
4,581,618 A * 4/1986 Watanabe et al. ..... 346/134
5,793,399 A * 8/1998 Kawakami et al. ..... 347/104
5,971,386 A * 10/1999 Jean et al. ..... 271/4.08
6,601,843 B2 * 8/2003 Miki ..... 271/10.13
6,672,581 B2 * 1/2004 Lee et al. ..... 271/164
6,792,242 B2 * 9/2004 Suzaki ..... 399/392
6,837,489 B2 * 1/2005 Kim ..... 271/3.14
2002/0033571 A1 * 3/2002 Matsuda ..... 271/10.11
2003/0209849 A1 * 11/2003 Lee et al. ..... 271/10.04
2004/0032074 A1 * 2/2004 Park ..... 271/4.01
2004/0061274 A1 * 4/2004 Tsunematsu ..... 271/10.01

* cited by examiner

*Primary Examiner*—David H. Bollinger
(74) *Attorney, Agent, or Firm*—Rabin & Berdo, P.C.

(57) ABSTRACT

A media conveying mechanism located in a media data recorder for conveying media mainly includes a driving motor to provide driving power needed. A first clutch to control the operation of a pickup roller. A second clutch to control rotation direction of an intermediate roller, a sensor to detect the conveying process of the media and control the operation of the second clutch. By deploying the two clutches, conveying quantity of the media in a unit time period can be effectively improved.

14 Claims, 4 Drawing Sheets

MEDIA CONVEYING MECHANISM

FIELD OF THE INVENTION

The present invention relates to a media conveying mechanism adopted for use on media data recorders such as printers, facsimile machines, scanners and the like to convey media and particularly to a media conveying mechanism to greatly improve media conveying speed.

BACKGROUND OF THE INVENTION

Media data recorders are widely used in individual and industrial businesses such as exchange of letters and documents, performing document scanning, printing, copying or facsimile operations. There is a wide variety of media data recorders, such as ink-jets, lasers and impact printers, plotters, scanners, copiers, multi-functional peripheral (MFP), and the like. Printing quality and operation efficiency of the media data recorders have always been key development focuses in this industry.

The present media data recorders, such as copiers, mostly employ roller mechanisms to convey media in the operations of media feeding, scanning, printing or discharging. FIGS. 1A and 1B illustrate the general or conventional technique of the media conveying mechanism that is usually adopted. It mainly includes a pickup roller 110, intermediate roller 120 and delivery roller 130. A motor 100 provides the driving power required for roller operation. In practice, there are also belts or a plurality of auxiliary gears to couple with the main operation gears and motor 100. The drawings show only three main operation gears. When a copier media (such as paper 200) is fed, the pickup roller 110 and the intermediate roller 120 rotate counterclockwise at the same time to pick up the paper 200. Meanwhile, the delivery roller 130 rotates clockwise aiming to align the front edge of the paper 200 before it arrives at the delivery roller 130 so that the paper 200 can pass through an image processing device 140 and obtain correct image output without skewing. As shown in FIG. 1B, after the paper 200 has been aligned, the delivery roller 130 transports the paper 200 for discharging with the aid of the rotating intermediate roller 120.

The operation of the conventional mechanism set forth above requires a motor 100 to switch rotation clockwise or counterclockwise. And only when the paper 200 has been completely moved away from the delivery roller 130 can the motor 100 switch operation direction to pick up the next paper 200. Hence two consecutive papers 200 have to be spaced from each other for a long distance. This causes unnecessary idling of the image-processing device 140 or other printing conveying modules. This is not efficient.

SUMMARY OF THE INVENTION

In view of the aforesaid disadvantages, the primary object of the invention is to provide a media conveying mechanism for use on media data recorders such as copiers, facsimile machines, multi-functional peripherals and the like to effectively improve media conveying speed.

The media conveying mechanism of the invention mainly includes a driving motor, first clutch, second clutch, pickup roller, intermediate roller, delivery roller and sensor. The driving motor provides driving power required by the mechanism during operation. The pickup roller is installed on the starting location of the media-conveying path of the mechanism to transport the papers. The first clutch is coupled with the driving motor and located on the media-conveying path to control the operation of the pickup roller. The intermediate roller is located on the media-conveying path to aid media transportation. The second clutch, like the first clutch, also is coupled with the driving motor to control the operation of the intermediate roller. The sensor is located on the media-conveying path to detect the paper conveying process and control the operation of the second clutch. The delivery roller is located on a distal end of the media-conveying path for discharging the media outside the mechanism.

During operation, first, the pickup roller catches and rolls the media into the media-conveying path. Next, the first clutch is pressed by the media to stop the operation of the pickup roller, and the intermediate roller continuously conveys the paper. When the sensor detects the front edge of the paper, the delivery roller rotates in the direction contrary to the intermediate roller so that the front edge of the paper may be aligned before arriving the delivery roller. The aligned paper is transported to leave the mechanism by the delivery roller and the intermediate roller; finally the paper is caught and discharged outside the mechanism by a discharge roller. When the rear edge of the paper departs from the first clutch, the first clutch returns to its original condition to continuously drive the pickup roller to fetch the next paper. Compared with the conventional techniques that convey the next media only after the paper has completely departed from the media mechanism, the mechanism of the invention can start conveying operation for the next paper when the rear edge of the current paper departs from the first clutch. Thus media conveying time is effectively reduced, and media-conveying speed greatly improves.

The foregoing, as well as additional objects, features and advantages of the invention will be more readily apparent from the following detailed description, which proceeds with reference to the accompanying drawings.

DESCRIPTION OF THE PREFERRED EMBODIMENTS

The media conveying mechanism according to the invention is installed in media data recorders for conveying a selected number of papers. It mainly aims to speed up media conveying speed.

Figure 1A:
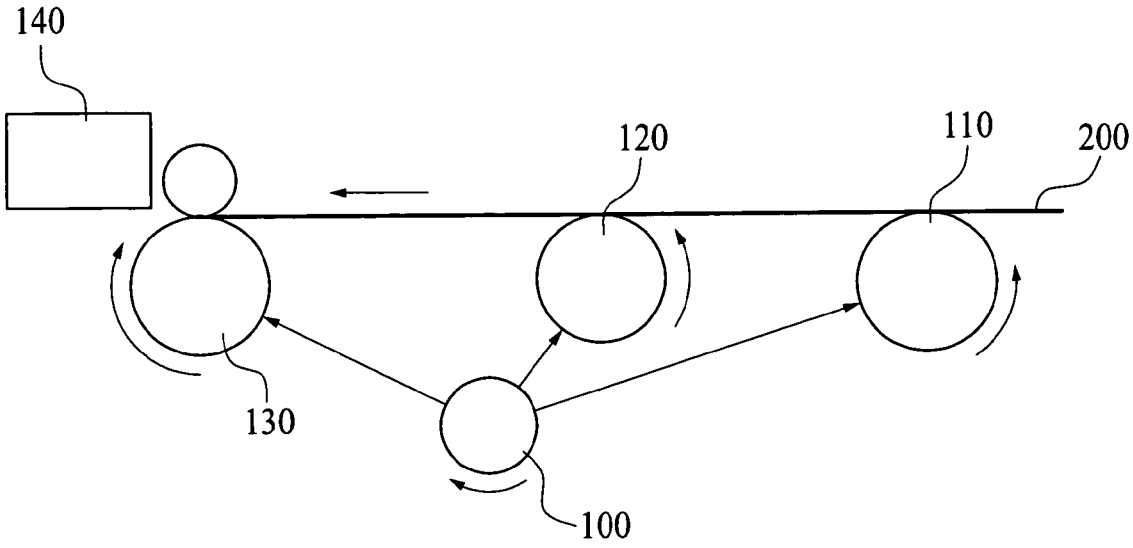
FIG. 1A (PRIOR ART)
FIGS. 1A and 1B are schematic views of a conventional media conveying mechanism in operating condition.
Figure 1B:
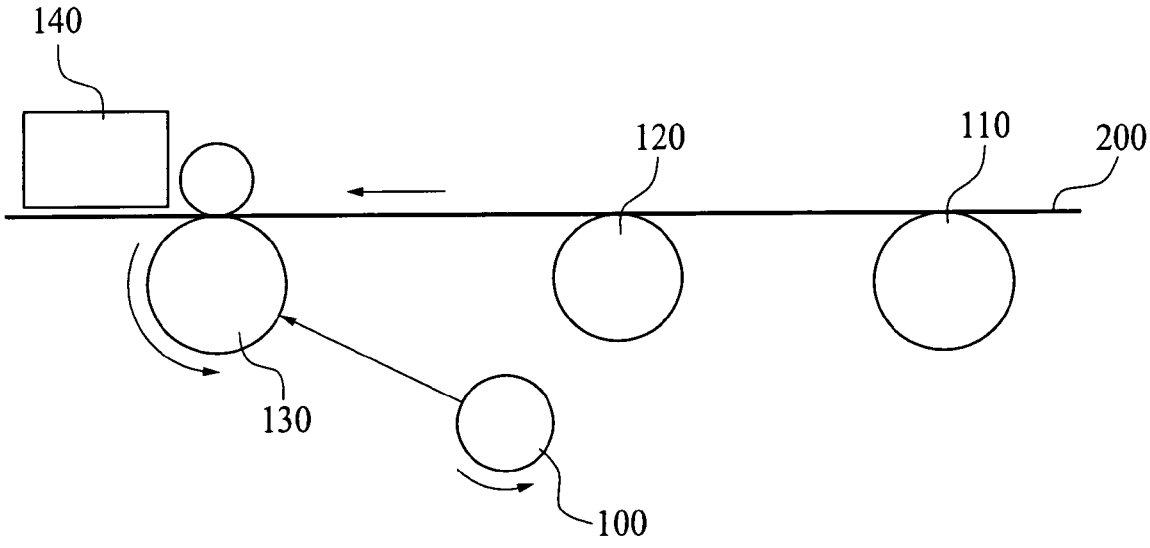
FIG. 1B (PRIOR ART)
Figure 2:
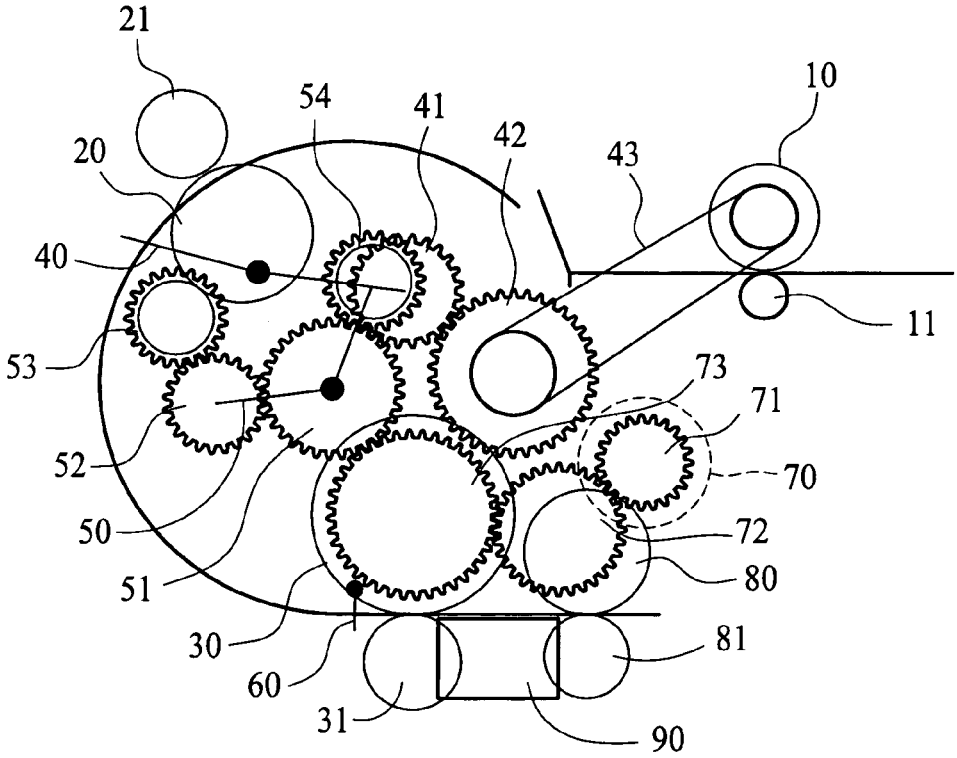
FIG. 2 is a schematic view of the media conveying mechanism of the invention.

Refer to FIG. 2 for the basic structure of the media conveying mechanism of the invention. It has a media conveying path, along the moving direction of media 200, there are a pickup roller 10, an intermediate roller 20, a delivery roller 30 and a discharge roller 80 disposed in this order. There is an auxiliary pickup roller 11 installed on a location corresponding to the pickup roller 10, and spaced from the pickup roller 10 at a selected distance to couple with the pickup roller 10 to catch papers 200 of different thickness. There is also an auxiliary intermediate roller 21 installed on a location corresponding to the intermediate roller 20 and spaced from the intermediate roller 20 at a selected distance to couple with the intermediate roller 20 to catch papers 200 of different thickness. There is further an auxiliary delivery roller 31 installed on a location corresponding to the delivery roller 30 and spaced from the delivery roller 30 at a selected distance to couple with the delivery roller 30 to catch papers 200 of different thickness. Similarly, there is an auxiliary discharge roller 81 installed on a location corresponding to the discharge roller 80 and spaced from the discharge roller 80 at a selected distance to couple with the discharge roller 80 to catch papers 200 of different thickness.

The driving motor 70 provides the driving power required for the operation of the entire mechanism. It drives a first driving gear 71, a second driving gear 72 and a third driving gear 73. While three driving gears are indicated in the drawings, it is by no means the limit of the driving gear number that can be used to transmit the driving power to other elements. The first clutch is coupled to the driving motor 70 via the gears and is located on the media conveying path to control the operation of the pickup roller 10. The first clutch consists of a first clutch lever 40, a first clutch gear 41 and a first clutch idle gear 42. The first clutch lever 40 is installed in the media data recorder in a swinging manner and may be extended outside the media-conveying path. An elastic element (such as a torsion spring) may be installed on the juncture of the first clutch lever 40 and the media data recorder to allow the media 200 to press the first clutch lever 40 to generate a swinging motion. The first clutch gear 41 is located on one side of the first clutch lever 40. The first clutch idle gear 42 is coupled with the first clutch gear and drives the pickup roller 10 through a belt 43. Of course direct coupling may be adopted to transmit the driving power without using the belt 43 as shown in the drawings. The second clutch consists of a second clutch lever 50 installed in the media data recorder in a swinging manner and a first idle gear 51 coupled with the driving motor 70. The second clutch lever 50 and the first idle gear 51 have a friction force formed there between. When the first idle gear 51 changes rotating direction, the second clutch lever 50 rotates accordingly. There is a second clutch right gear 54 installed on one end of the second clutch lever 50 to couple with the first idle gear 51. A second clutch left gear 52 is installed on other end of the second clutch lever 50 to couple with the first idle gear 51. There is further a sensor 60 located on a distal end of the media conveying path to control the operation of the second clutch.

Figure 3:
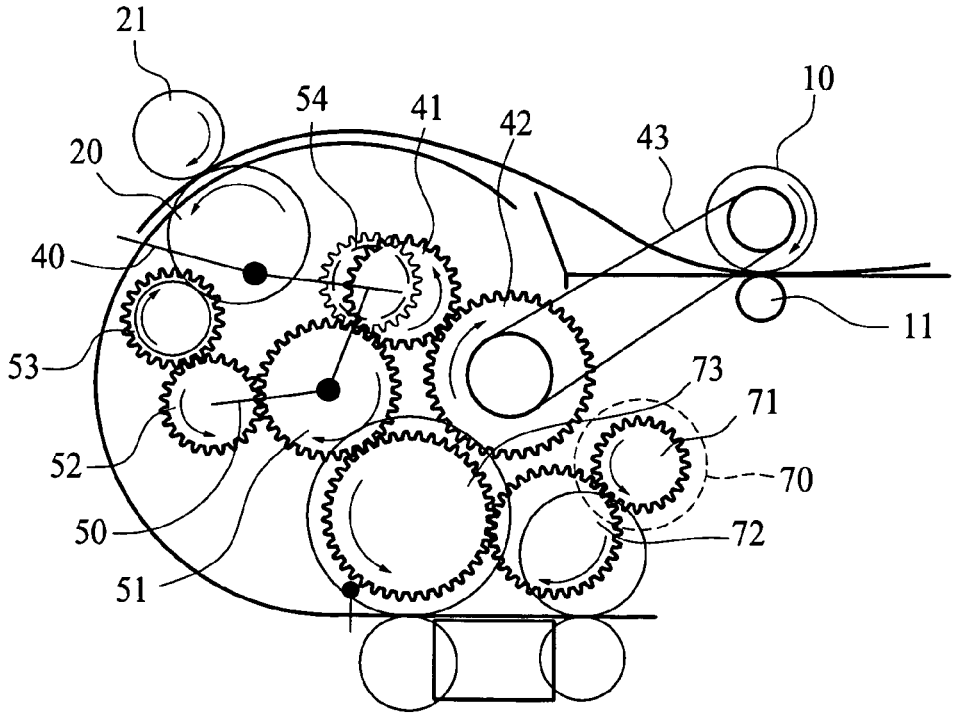
FIGS. 3 through 7 are schematic views of the media conveying mechanism of the invention in operating condition.
Figure 4:
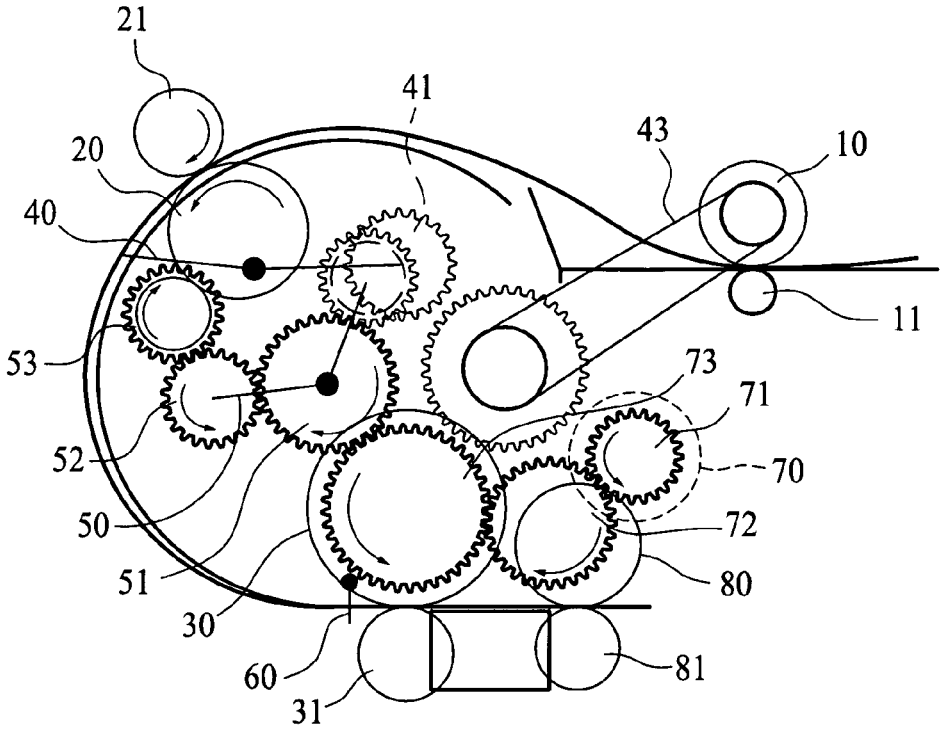
Figure 5:
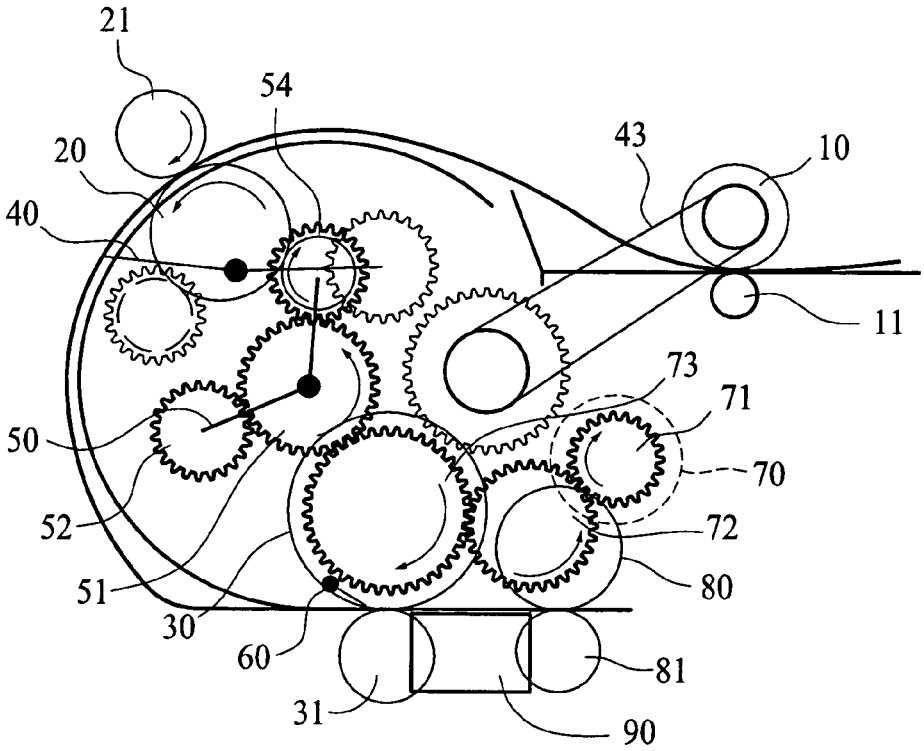

FIG. 2 and the construction set forth generally illustrate the mechanism of the invention. The movements and operational relationship of various elements are elaborated as follows:

Referring to FIG. 3, first, the driving motor 70 provides driving power which is transferred through the first idle gear 51, first clutch gear 41 and first clutch idle gear 42 to pick up the paper 200 by coupling with the auxiliary pickup roller 11 until the paper 200 is in contact the first clutch lever 40. Referring to FIG. 4, the front edge of the paper 200 touches the first clutch lever 40 and continuously moves forwards and presses the first clutch lever 40 to turn a selected angle. Thereby, the first clutch gear 41 is moved away from the first clutch idle gear 42 to stop the pickup roller 10 from fetching the papers 200. Meanwhile, the forward movement of the papers 200 is taken over by the intermediate roller 20 and the auxiliary intermediate roller 21. The driving power for the operation of the intermediate roller 20 is transferred from the driving motor 70 through the first idle gear 51, second clutch left gear 52 and second idle gear 53. The rotation direction of the intermediate roller 20 is the same as the rotation direction of the delivery roller 30. Referring to FIG. 5, when the front edge of the media 200 is detected by the sensor 60, an electronic signal is transmitted to control the driving motor 70 to change rotation direction and move the second clutch lever 50 to turn a selected angle. After the second clutch lever 50 has been turned, the second clutch left gear 52 is disengaged with the second idle gear, and the second clutch right gear 54 is directly coupled with the intermediate roller 20 to continuously move the media 200 forwards. As the rotation direction of the intermediate roller 20 is contrary to the deliver roller 30, the front edge of the paper 200 will be aligned in front of the delivery roller 30.

Figure 6:
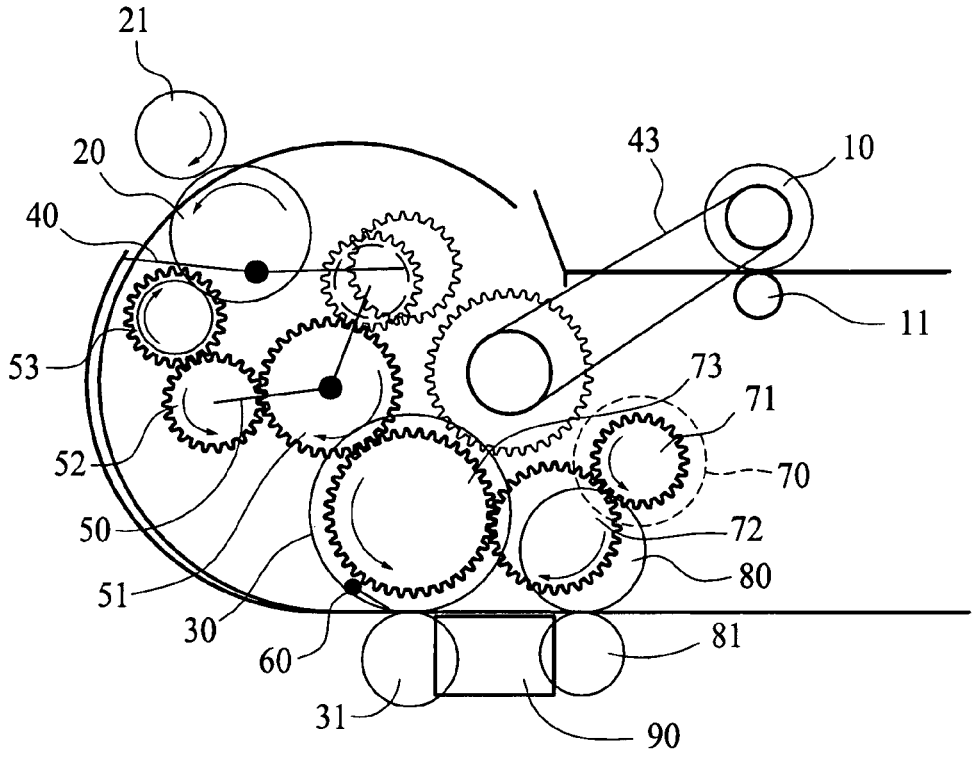
Figure 7:
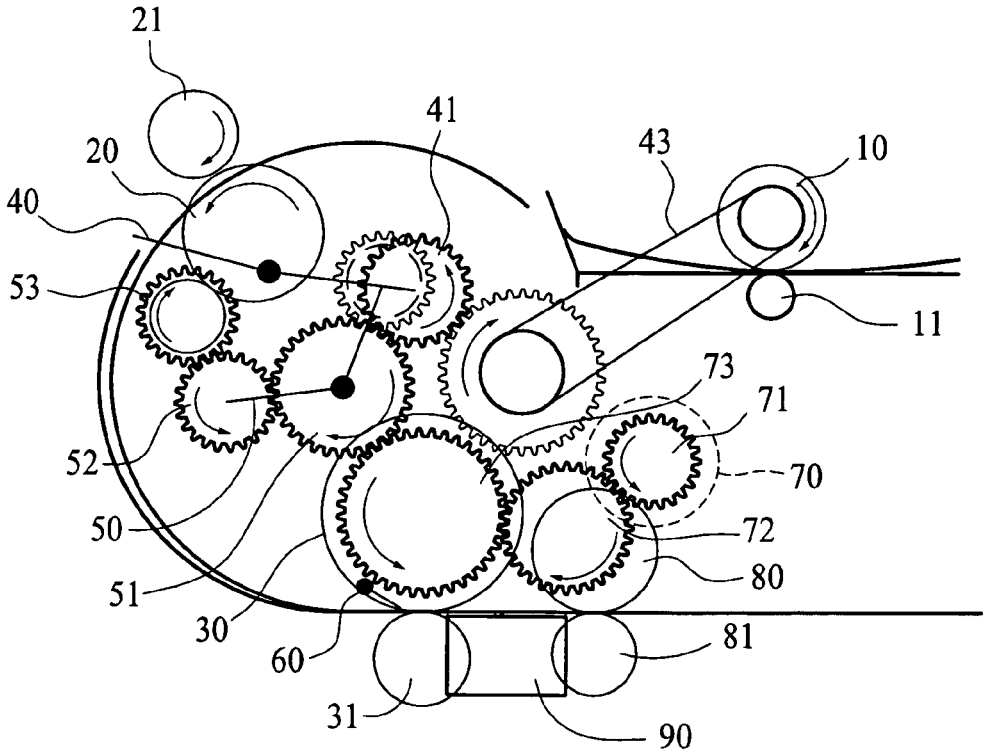

Referring to FIG. 6, after the front edge of the paper 200 has been aligned, the rotation direction of the driving motor 70 changes again, and the paper 200 is moved away by the delivery roller 30 and the discharge roller 80. Data on the paper 200 may be read by an image-capturing device 90. Other operations related to the paper 200 may also be executed through other selected devices. Referring to FIG. 7, when the rear edge of the paper 200 departs from the first clutch lever 40, the first clutch lever 40 returns to its original position. Further, the first clutch gear 41 drops to engage with the first clutch idle gear 42 to transfer the driving power of the driving motor 70 and drive the pickup roller 10 to pick up the next paper 200.

By means of the construction set forth above, the media conveying mechanism of the invention can provide the following advantages:

1. High speed media feeding operation: Compared with the conventional techniques that have to move the paper away completely from the media conveying mechanism before picking up another paper, the invention can start paper feeding operation for the next paper when the rear edge of the current paper leaves the first clutch lever. Thus unit paper conveying time can be greatly reduced to achieve high-speed paper feeding operation.
2. Simple construction: The media conveying mechanism of the invention has a simple structure which employs simple clutch mechanisms. Fabrication and assembly can be accomplished in a short time, to facilitate production. The costs are also lower. Thus competitiveness of the product can be enhanced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A media conveying mechanism installed in a media data recorder for conveying a selected number of media, comprising:

a driving motor which provides driving power required for operation of the mechanism;

a pickup roller located on a start location of a media conveying path of the mechanism to pick up the media;

a first clutch coupled to the pickup roller, and being coupled to the driving motor via at least one driving gear, and being located on the media conveying path for controlling an operation of the pickup roller;

an intermediate roller located on the media conveying path for moving the media;

a second clutch coupled to the intermediate roller, and being coupled to the driving motor via the at least one driving gear for controlling an operation of the intermediate roller;

a sensor located on the media conveying path for controlling an operation of the second clutch; and a delivery roller located on a distal end of the media conveying path for discharging the media outside the mechanism.

2. The media conveying mechanism of claim 1, wherein the first clutch includes:

a first dutch lever located in the media data recorder in a swingable manner;

a first clutch gear locatad on one side of the first clutch lever; and a first clutch idle gear coupled with the first clutch gear and the pickup roller;

wherein the first clutch gear drives the first clutch idle gear to rotate the pickup roller.

3. The media conveying mechanism of claim 2, wherein the first clutch lever is pressable by the media to turn a selected angle such that the first clutch gear is moved away from the first clutch idle gear to stop the operation of the pickup roller.

4. The media conveying mechanism of claim 1, wherein the second clutch includes:

a second clutch lever located in the media data recorder in a swingable manner;

a first idle gear coupled to the driving motor;

a second clutch right gear located on one end of the second clutch lever and coupled with the first idle gear;

a second clutch left gear located on an other end of the second clutch lever and coupled with the first idle gear; and a second idle gear coupled with one side of the intermediate roller;

wherein the first idle gear drives the second clutch left gear and the second idle gear to allow the intermediate roller to rotate in the same direction of the pickup roller.

5. The media conveying mechanism of claim 4, wherein the second clutch left gear is separated from the second idle gear when the second clutch lever has been turned to a selected angle so that the second clutch right gear is coupled with the intermediate roller to drive the intermediate gear to rotate in a direction opposite to that of the pickup roller.

6. The media conveying mechanism of claim 1, further having a discharge roller located on one side of the delivery roller to aid delivery of the media.

7. The media conveying mechanism of claim 6, further having an auxiliary discharge roller located on a position corresponding to the discharge roller to couple with the discharge roller to catch the media.

8. The media conveying mechanism of claim 7, wherein the discharge roller and the auxiliary discharge roller are spaced from each other for a selected distance for catching the media of different thickness.

9. The media conveying mechanism of claim 1, further having an auxiliary pickup roller located on a position corresponding to the pickup roller to couple with the pickup roller to catch the media.

10. The media conveying mechanism of claim 9, wherein the pickup roller and the auxiliary pickup roller are spaced from each other for a selected distance for catching the media of different thickness.

11. The media conveying mechanism of claim 1, further having an auxiliary intermediate roller located on a position corresponding to the intermediate roller to couple with the intermediate roller to catch the media.

12. The media conveying mechanism of claim 11, wherein the intermediate roller and the auxiliary intermediate roller are spaced from each other for a selected distance for catching the media of different thickness.

13. The media conveying mechanism of claim 1, further having an auxiliary delivery roller located on a position corresponding to the delivery roller to couple with the delivery roller to catch the media.

14. The media conveying mechanism of claim 13, wherein the delivery roller and the auxiliary delivery roller are spaced from each other for a selected distance for catching the media of different thickness.

* * * * *